US005765725A

United States Patent [19]

Matt

[11] Patent Number: 5,765,725

[45] Date of Patent: Jun. 16, 1998

[54] DUAL COMPARTMENT SQUEEZABLE DISPENSING CONTAINER AND CAP

[76] Inventor: William Matt, 379 Congress Ave., East Willston, N.Y. 11569

[21] Appl. No.: 654,210

[22] Filed: May 28, 1996

[51] Int. Cl.[6] ..... B65D 37/00

[52] U.S. Cl. ..... 222/129; 222/212

[58] Field of Search ..... 222/94, 129, 143, 222/144.5, 212, 215, 482, 484, 485

[56] References Cited

U.S. PATENT DOCUMENTS

| | | | |
|---|---|---|---|
| 2,611,499 | 9/1952 | Mayer | 215/6 |
| 2,661,870 | 12/1953 | Huenergardt | 222/129 |
| 2,661,871 | 12/1953 | Huenergardt | 222/129 |
| 3,076,573 | 2/1963 | Thomas | 215/6 |
| 3,269,389 | 8/1966 | Meurer et al. | 128/198 |
| 3,506,157 | 4/1970 | Dukess | 222/94 |
| 3,891,125 | 6/1975 | Morane et al. | 222/129 |
| 4,148,417 | 4/1979 | Simmons | 222/94 |
| 4,279,349 | 7/1981 | Aigner | 215/6 |
| 4,802,608 | 2/1989 | Hofmann | 222/556 X |
| 4,962,869 | 10/1990 | Gross et al. | 222/556 X |
| 4,964,539 | 10/1990 | Mueller | 222/94 |
| 4,984,715 | 1/1991 | Green | 222/212 X |
| 5,062,550 | 11/1991 | Singh | 222/212 X |
| 5,102,016 | 4/1992 | Ball et al. | 222/212 X |
| 5,232,108 | 8/1993 | Nakamura | 215/6 |
| 5,257,704 | 11/1993 | Gutt | 215/246 |
| 5,318,203 | 6/1994 | Iaia et al. | 222/94 |
| 5,356,040 | 10/1994 | Reggiani | 222/129 |
| 5,392,947 | 2/1995 | Gentile | 220/665 |
| 5,588,550 | 12/1996 | Meyer | 222/482 X |

*Primary Examiner*—Kenneth Bomberg
*Attorney, Agent, or Firm*—Richard L. Miller, P.E.

[57] ABSTRACT

A dual compartment squeezable dispensing container that alternatively selectively dispenses independently two separate fluid components at a selected speed and in a selected direction that includes a container portion, a cap portion, and selection apparatus. The container portion has two separate compartments and contains the two separate fluid components. The cap portion is replaceably and securingly attached to the hollow container. And, the selection apparatus is associated with the cap portion and alternatively selectively dispenses independently the two separate fluid components at the selected speed and in the selected direction.

15 Claims, 1 Drawing Sheet

DUAL COMPARTMENT SQUEEZABLE DISPENSING CONTAINER AND CAP

BACKGROUND OF THE INVENTION

The present invention relates to a container. More particularly, the present invention relates to a dual compartment squeezable dispensing container that alternatively selectively dispenses independently two separate fluid components at a selected speed and in a selected direction that includes a container portion, a cap portion, and selection apparatus.

There are products that comprise two active components that are to be mixed in appropriate proportions. The problem which arises is indeed linked to the active components, which in some cases lose or severely limit their individuality when placed in contact with each other prior to use.

In many fields there is a need to keep chemically incompatible liquids or emulsions separate until they are dispensed. In order to solve this problem, dual component containers have been used that have at least one pair of compartments.

The containers usually comprise a pair of containers, in the case of two components, which are kept close together by means of an external retention cup within which they are inserted with cone of their ends. This solution, however, leads to considerable problems, since the connection of the two containers is not stable. It should be furthermore stressed that the outer cup, which may also be metallic, reduces the printable surface of the containers, to the detriment of the information which must be printed thereon according to the applicable statutory provisions.

Numerous innovations for dual compartment containers have been provided in the prior art that will be described. Even though these innovations may be suitable for the specific individual purposes to which they address, however, they differ from the present invention in that they do not teach a dual compartment squeezable dispensing container that alternatively selectively dispenses independently two separate fluid components at a selected speed and in a selected direction that includes a container portion, a cap portion, and selection apparatus.

For example, U.S. Pat. No. 2,611,499 to Mayer teaches a cylindrical, as well as to other suitably shaped containers, which may be of convex or bulbous body configuration and are provided with opposite opening ends, which are closable by caps, such as screw caps of conventional design.

Another example, U.S. Pat. No. 3,076,573 to Thomas teaches a dispensing closure that includes a resilient cap having a dispensing opening, means for attachment to the neck of the container, and ridges or protuberances on the cap to cooperate alternatively, upon movement of the cap, with raised and depressed portions on the container neck so as to alternatively produce an outwardly tensioned and an inwardly relaxed condition of the dispensing cap as the dispensing opening is taken in or out of resilient yieldable registry with an opening in the container neck.

Still another example, U.S. Pat. No. 3,269,389 to Meurer et al. teaches a single flexible resilient unit container that holds in separate compartments two non-compatible products until they have been separately but simultaneously exited from the container.

Yet another example, U.S. Pat. No. 3,891,125 to Morane et al. teaches a device for storing two products separately and then mixing them that includes a container having a neck and holding one product, a hollow cap screwed onto the neck and holding the other product, a capsule force-fitted into the hollow cap to close the product-holding recess therein, and a cup which is frictionally gripped in the neck.

Still yet another example, U.S. Pat. No. 4,279,349 to Aigner teaches a bottle that is constructed with separate compartments for different liquids. The neck of the bottle is divided internally by a longitudinally extending partition, two sides of each communicating exclusively with one of the compartments.

Yet still another example, U.S. Pat. No. 5,232,108 to Nakamura teaches a preform that includes an open top portion, a cylindrical barrel portion, and a bottom portion formed to close the barrel portion at the end opposite to the open top portion.

The preform also has an internal partition wall formed to extend across the interior of the barrel portion and from the bottom portion. In the transverse direction relative to the longitudinal center axis of the preform, the internal partition wall has the maximum wall thickness at the connection between the inner wall of the barrel portion and the internal partition wall, the maximum wall thickness being gradually reduced towards the longitudinal center axis of the preform with the minimum wall thickness at a position near the longitudinal center axis of the preform.

Still yet another example, U.S. Pat. No. 5,257,704 to Gutt teaches A tamper-proof lipstick seal that includes a rectangular laminate that has affixed to one edge a pull tab which protrudes from the edge of the laminate.

Yet still another example, U.S. Pat. No. 5,356,040 to Reggiani teaches a container particularly for dual compartment products that includes a first and a second tank each having, on a respective outer wall, a median portion which rises from the wall itself. The medium portion is provided with seats for accommodating engagement pins which rise from a coupling partition provided with a frame shaped complementarily with respect to each outer wall of the tanks.

Finally, still yet another example, U.S. Pat. No. 5,392,947 to Gentile teaches a dental wash product that includes a dispensing container with at least two discreet compartments. A closure mechanism is sealingly attached to an upper end of the dispensing container. A structure for inhibiting gurgling of the liquid that can occur upon dispensing is provided in the form of either a vent pipe, a divider wall or a U-shaped divider wall. Additionally, there is provided a child-proof mechanism in the form of a release-button controlling opening of a sealing cover on the closure mechanism.

It is apparent that numerous innovations for dual compartment containers have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Accordingly, an object of the present invention is to provide a dual compartment squeezable dispensing container that avoids the disadvantages of the prior art.

Another object of the present invention is to provide a dual compartment squeezable dispensing container that is simple and inexpensive to manufacture.

Still another object of the present invention is to provide a dual compartment squeezable dispensing container that is simple to use.

Briefly stated, yet another object of the present invention is to provide a dual compartment squeezable dispensing container that alternatively selectively dispenses two separate fluid components at a selected speed and in a selected direction that includes a container portion, a cap portion, and selection apparatus.

Still yet another object of the present invention is to provide a dual compartment squeezable dispensing container wherein the container portion has two separate compartments and contains the two separate fluid components.

Yet still another object of the present invention is to provide a dual compartment squeezable dispensing container wherein the cap portion is replaceably and securingly attached to the hollow container.

Still yet another object of the present invention is to provide a dual compartment squeezable dispensing container wherein the selection apparatus is associated with the cap portion and alternatively selectively dispenses independently the two separate fluid components at the selected speed and in the selected direction.

Yet still another object of the present invention is to provide a dual compartment squeezable dispensing container wherein the container portion includes a hollow and generally cylindrically-shaped body that has a closed and generally circular-shaped bottom with a circular-shaped interior surface and a perimeter.

Still yet another object of the present invention is to provide a dual compartment squeezable dispensing container wherein the hollow and generally cylindrically-shaped body of the container portion further has a substantially closed and generally hemispherically-shaped top with a perimeter, a generally hemispherically-shaped interior surface, and a centrally-disposed and circular-shaped throughbore with a perimeter and a center that extends centrally therethrough.

Yet still another object of the present invention is to provide a dual compartment squeezable dispensing container wherein the hollow and generally cylindrically-shaped body of the container portion further has a generally cylindrically-shaped longitudinal side with a generally cylindrically-shaped interior surface which extends from the perimeter of the closed and generally circular-shaped bottom of the hollow and generally cylindrically-shaped body of the container portion to the perimeter of the substantially closed and generally hemispherically-shaped top of the hollow and generally cylindrically-shaped body of the container portion.

Still yet another object of the present invention is to provide a dual compartment squeezable dispensing container wherein the hollow and generally cylindrically-shaped body of the container portion further has a longitudinal axis that extends longitudinally centrally through the center of the container portion body top centrally-disposed and circular-shaped throughbore of the substantially closed and generally hemispherically-shaped top of the hollow and generally cylindrically-shaped body of the container portion.

Yet still another object of the present invention is to provide a dual compartment squeezable dispensing container wherein the hollow and generally cylindrically-shaped body of the container portion further has a longitudinally-disposed and generally rectangular-shaped partition that extends along the longitudinal axis of the hollow and generally cylindrically-shaped body of the container portion from the generally circular-shaped interior surface of the closed and generally circular-shaped bottom of the hollow and generally cylindrically-shaped body of the container portion to the generally hemispherically-shaped interior surface of the substantially closed and generally hemispherically-shaped top of the hollow and generally cylindrically-shaped body of the container portion and across the generally cylindrically-shaped interior surface of the generally cylindrically-shaped longitudinal side of the hollow and generally cylindrically-shaped body of the container portion.

Still yet another object of the present invention is to provide a dual compartment squeezable dispensing container wherein the longitudinally-disposed and generally rectangular-shaped partition of the hollow and generally cylindrically-shaped body of the container portion divides the hollow and generally cylindrically-shaped body of the container portion into one of the two separate compartments of the container portion which is a first generally semi-cylindrically-shaped compartment that contains one of the two separate fluid components and into another one of the two separate compartments of the container portion which is a second generally semi-cylindrically-shaped compartment that contains another one of the two separate fluid components.

Yet still another object of the present invention is to provide a dual compartment squeezable dispensing container wherein the container portion further includes a hollow and cylindrically-shaped neck.

Still yet another object of the present invention is to provide a dual compartment squeezable dispensing container wherein the hollow and cylindrically-shaped neck of the container portion has an opened and circular-shaped bottom that has a perimeter and is integral with, and extends perpendicularly upwardly from, the perimeter of the centrally-disposed and circular-shaped throughbore of the substantially closed and generally hemispherically-shaped top of the hollow and generally cylindrically-shaped body of the container portion.

Yet still another object of the present invention is to provide a dual compartment squeezable dispensing container wherein the cylindrically-shaped neck of the container portion further has a substantially closed and circular-shaped top with a perimeter, a circular-shaped interior surface, a first offset and circular-shaped throughbore that extends therethrough, and a second offset and circular-shaped throughbore that extends therethrough opposite to, and offset from, the first offset and circular-shaped throughbore of the substantially closed and circular-shaped top of the hollow and cylindrically-shaped neck of the container portion.

Still yet another object of the present invention is to provide a dual compartment squeezable dispensing container wherein the hollow and cylindrically-shaped neck of the container portion further has a cylindrically-shaped longitudinal side with a cylindrically-shaped interior surface which extends from the perimeter of the open and circular-shaped bottom of the hollow and cylindrically-shaped neck of the container portion to the perimeter of the substantially closed and circular-shaped top of the hollow and cylindrically-shaped neck of the container portion.

Yet still another object of the present invention is to provide a dual compartment squeezable dispensing container wherein the hollow and cylindrically-shaped neck of the container portion further has a longitudinal axis that is collinear with the longitudinal axis of the hollow and generally cylindrically-shaped body of the container portion.

Still yet another object of the present invention is to provide a dual compartment squeezable dispensing container wherein the substantially closed and circular-shaped top of the hollow and cylindrically-shaped neck of the container portion extends slightly radially outwardly from the cylindrically-shaped longitudinal side of the hollow and cylindrically-shaped neck of the container portion so as to form a radially-outwardly-extending, circumferentially-disposed, and circular-shaped lip therearound.

Yet still another object of the present invention is to provide a dual compartment squeezable dispensing container wherein the radially-outwardly-extending, circumferentially-disposed, and circular-shaped lip of the substantially closed and circular-shaped top of the hollow and cylindrically-shaped neck of the container portion provides frictional engagement with the cap portion when replaceably secured to the hollow and cylindrically-shaped neck of the container portion.

Still yet another object of the present invention is to provide a dual compartment squeezable dispensing container wherein the hollow and cylindrically-shaped neck of the container portion further has a longitudinally-disposed and generally rectangular-shaped partition that is integral with, and extends coplanarly-upwardly from the longitudinally-disposed and generally rectangular-shaped partition of the container portion along the longitudinal axis of the hollow and cylindrically-shaped neck of the container portion to the circular-shaped interior surface of the substantially closed and circular-shaped top of the hollow and cylindrically-shaped neck of the container portion and across the cylindrically-shaped interior surface of the cylindrically-shaped longitudinal side of the hollow and cylindrically-shaped neck of the container portion.

Yet still another object of the present invention is to provide a dual compartment squeezable dispensing container wherein the longitudinally-disposed and generally rectangular-shaped partition of the hollow and cylindrically-shaped neck of the container portion divides the hollow and cylindrically-shaped neck of the container portion into a first generally semi-cylindrically-shaped compartment that is in fluid communication with both the first generally semi-cylindrically-shaped compartment of the hollow and generally cylindrically-shaped body of the container portion and the first offset and circular-shaped throughbore of the substantially closed and circular-shaped top of the hollow and cylindrically-shaped neck of the container portion, and into a second generally semi-cylindrically-shaped compartment that is in fluid communication with both the second generally semi-cylindrically-shaped compartment of the hollow and generally cylindrically-shaped body of the container portion and the second offset and circular-shaped throughbore of the substantially closed and circular-shaped top of the hollow and cylindrically-shaped neck of the container portion.

Still yet another object of the present invention is to provide a dual compartment squeezable dispensing container wherein the first offset and circular-shaped throughbore of the substantially closed and circular-shaped top of the hollow and cylindrically-shaped neck of the container portion is positioned adjacent to one side of the longitudinally-disposed and generally rectangular-shaped partition of the hollow and cylindrically-shaped neck of the container portion and adjacent to one side of an imaginary perpendicular bisector of the longitudinally-disposed and generally rectangular-shaped partition of the hollow and cylindrically-shaped neck of the container portion.

Yet still another object of the present invention is to provide a dual compartment squeezable dispensing container wherein the second offset and circular-shaped throughbore of the substantially closed and circular-shaped top of the hollow and cylindrically-shaped neck of the container portion is positioned adjacent to an opposite side of the longitudinally-disposed and generally rectangular-shaped partition of the hollow and cylindrically-shaped neck of the container portion and adjacent to an opposite side of the imaginary perpendicular bisector of the longitudinally-disposed and generally rectangular-shaped partition of the hollow and cylindrically-shaped neck of the container portion.

Still yet another object of the present invention is to provide a dual compartment squeezable dispensing container wherein the cap portion includes a hollow and cylindrically-shaped body that has a circular-shaped bottom with a perimeter.

Yet still another object of the present invention is to provide a dual compartment squeezable dispensing container wherein the hollow and cylindrically-shaped body of the cap portion further has an open and circular-shaped top with a perimeter.

Still yet another object of the present invention is to provide a dual compartment squeezable dispensing container wherein the hollow and cylindrically-shaped body of the cap portion further has a cylindrically-shaped longitudinal side with a cylindrically-shaped interior surface which extends from the perimeter of the open and circular-shaped bottom of the hollow and cylindrically-shaped body of the cap portion to the perimeter of the open and circular-shaped top of the hollow and cylindrically-shaped body of the cap portion.

Yet still another object of the present invention is to provide a dual compartment squeezable dispensing container wherein the hollow and cylindrically-shaped body of the cap portion further has a longitudinal axis that is collinear with the longitudinal axis of the hollow and cylindrically-shaped neck of the container portion.

Still yet another object of the present invention is to provide a dual compartment squeezable dispensing container wherein the hollow and cylindrically-shaped body of the cap portion further has a substantially closed and laterally-oriented intermediate disk that has a perimeter and replaceably rests on the substantially closed and circular-shaped top of the hollow and cylindrically-shaped neck of the container portion and is disposed intermediate, and substantially parallel to, the open and circular-shaped bottom of the hollow and cylindrically-shaped body of the cap portion and the open and circular-shaped top of the hollow and cylindrically-shaped body of the cap portion.

Yet still another object of the present invention is to provide a dual compartment squeezable dispensing container wherein the perimeter of the substantially closed and laterally-oriented intermediate disk of the hollow and cylindrically-shaped body of the cap portion is coincident with the cylindrically-shaped interior surface of the cylindrically-shaped longitudinal side of the hollow and cylindrically-shaped body of the cap portion.

Still yet another object of the present invention is to provide a dual compartment squeezable dispensing container wherein the hollow and cylindrically-shaped body of the cap portion further has a longitudinally-disposed and rectangular-shaped partition that extends along the longitudinal axis of the hollow and cylindrically-shaped body of the cap portion perpendicularly upwardly from a diameter of the substantially closed and laterally-oriented intermediate disk of the hollow and cylindrically-shaped body of the cap portion to the open and circular-shaped top of the hollow and cylindrically-shaped body of the cap portion and across the cylindrically-shaped interior surface of the cylindrically-shaped longitudinal side of the hollow and cylindrically-shaped body of the cap portion.

Yet still another object of the present invention is to provide a dual compartment squeezable dispensing container wherein the longitudinally-disposed and rectangular-shaped partition of the hollow and cylindrically-shaped body of the cap portion is co-planar, and in vertical alignment with, the longitudinally-disposed and generally rectangular-shaped partition of the hollow and cylindrically-shaped neck of the container portion and divides the hollow and cylindrically-shaped body of the cap portion into a first semi-cylindrically-shaped compartment with an open top and a second semi-cylindrically-shaped compartment with an open top.

Still yet another object of the present invention is to provide a dual compartment squeezable dispensing container wherein the substantially closed and laterally-oriented intermediate disk of the hollow and cylindrically-shaped body of the cap portion has a first offset and circular-shaped throughbore that is positioned adjacent to one side of the longitudinally-disposed and rectangular-shaped partition of the hollow and cylindrically-shaped body of the cap portion, in the first semi-cylindrically-shaped compartment of the hollow and cylindrically-shaped body of the cap portion, and in vertical alignment with the first offset and circular-shaped throughbore of the substantially closed and circular-shaped top of the hollow and cylindrically-shaped neck of the container portion.

Yet still another object of the present invention is to provide a dual compartment squeezable dispensing container wherein the substantially closed and laterally-oriented intermediate disk of the hollow and cylindrically-shaped body of the cap portion further has a first hollow and cylindrically-shaped tube that has an uppermost end with a center point and passes perpendicularly through the first offset and circular-shaped throughbore of the substantially closed and laterally-oriented intermediate disk of the hollow and cylindrically-shaped body of the cap portion.

Still yet another object of the present invention is to provide a dual compartment squeezable dispensing container wherein the first hollow and cylindrically-shaped tube of the substantially closed and laterally-oriented intermediate disk of the hollow and cylindrically-shaped body of the cap portion extends from slightly below the open and circular-shaped top of the hollow and cylindrically-shaped body of the cap portion to slightly above the open and circular-shaped bottom of the hollow and cylindrically-shaped body of the cap portion and replaceable and sealingly enters the first offset and circular-shaped throughbore of the substantially closed and circular-shaped top of the hollow and cylindrically-shaped neck of the container portion where the first hollow and cylindrically-shaped tube of the substantially closed and laterally-oriented intermediate disk of the hollow and cylindrically-shaped body of the cap portion is in fluid communication with the first generally semi-cylindrically-shaped compartment of the hollow and cylindrically-shaped neck of the container portion.

Yet still another object of the present invention is to provide a dual compartment squeezable dispensing container wherein the substantially closed and laterally-oriented intermediate disk of the hollow and cylindrically-shaped body of the cap portion further has a second offset and circular-shaped throughbore that is positioned adjacent to an opposite side of the longitudinally-disposed and rectangular-shaped partition of the hollow and cylindrically-shaped body of the cap portion, in the second semi-cylindrically-shaped compartment of the hollow and cylindrically-shaped body of the cap portion, and in vertical alignment with the second offset and circular-shaped throughbore of the substantially closed and circular-shaped top of the hollow and cylindrically-shaped neck of the container portion.

Still yet another object of the present invention is to provide a dual compartment squeezable dispensing container wherein the substantially closed and laterally-oriented intermediate disk of the hollow and cylindrically-shaped body of the cap portion further has a second hollow and cylindrically-shaped tube that has an uppermost end with a center point and passes perpendicularly through the second offset and circular-shaped throughbore of the substantially closed and laterally-oriented intermediate disk of the hollow and cylindrically-shaped body of the cap portion.

Yet still another object of the present invention is to provide a dual compartment squeezable dispensing container wherein the second hollow and cylindrically-shaped tube of the substantially closed and laterally-oriented intermediate disk of the hollow and cylindrically-shaped body of the cap portion extends from slightly below the open and circular-shaped top of the hollow and cylindrically-shaped body of the cap portion to slightly above the open and circular-shaped bottom of the hollow and cylindrically-shaped body of the cap portion and replaceably and sealingly enters the second offset and circular-shaped throughbore of the substantially closed and circular-shaped top of the hollow and cylindrically-shaped neck of the container portion where the second hollow and cylindrically-shaped tube of the substantially closed and laterally-oriented intermediate disk of the hollow and cylindrically-shaped body of the cap portion is in fluid communication with the second generally semi-cylindrically-shaped compartment of the hollow and cylindrically-shaped neck of the container portion.

Still yet another object of the present invention is to provide a dual compartment squeezable dispensing container wherein the selection means includes a first pivotable and semi-circular-shaped cover that is pivotally mounted to the hollow and cylindrically-shaped body of the cap portion by a first pivot pin and selectively opens and closes that portion of the open and circular-shaped top of the hollow and cylindrically-shaped body of the cap portion that defines the top of the first semi-cylindrically-shaped compartment of the hollow and cylindrically-shaped body of the cap portion.

Yet still another object of the present invention is to provide a dual compartment squeezable dispensing container wherein the selected speed of the one fluid component of the first generally semi-cylindrically-shaped compartment of the hollow and generally cylindrically-shaped body of the container portion being dispensed therefrom is achieved by varying an amount that the first pivotable and semi-circular-shaped cover of the cap portion is opened.

Still yet another object of the present invention is to provide a dual compartment squeezable dispensing container wherein the first pivot pin of the first pivotable and semi-circular-shaped cover of the cap portion pivotally enters the cylindrically-shaped longitudinal side of the hollow and cylindrically-shaped body of the cap portion and pivotally enters perpendicularly the longitudinally-disposed and rectangular-shaped partition of the hollow and cylindrically-shaped body of the cap portion in a direction of an imaginary line drawn through the center point of the uppermost end of the second hollow and cylindrically-shaped tube of the substantially closed and laterally-oriented intermediate disk of the hollow and cylindrically-shaped body of the cap portion.

Yet still another object of the present invention is to provide a dual compartment squeezable dispensing container wherein the first pivot pin of the first pivotable and semi-circular-shaped cover of the cap portion divides the first pivotable and semi-circular-shaped cover into a first large sealing portion that has a lower surface and extends over and selectively opens and closes the uppermost end of the first hollow and cylindrically-shaped tube of the substantially closed and laterally-oriented intermediate disk of the hollow and cylindrically-shaped body of the cap portion while providing a reflective surface for achieving the selected direction of the one fluid component of the first generally semi-cylindrically-shaped compartment of the hollow and generally cylindrically-shaped body of the container portion being dispensed therefrom, and a first small pressing portion that is smaller than the first large sealing portion of the first pivotable and semi-circular-shaped cover of the cap portion, as a result of positioning of the first cover pivot pin of the first pivotable and semi-circular-shaped cover of the cap portion.

Still yet another object of the present invention is to provide a dual compartment squeezable dispensing container wherein the lower surface of the first large sealing portion of the first pivotable and semi-circular-shaped cover of the cap portion has a sealing ring disposed thereon to assure a positive seal with the uppermost end of the first hollow and cylindrically-shaped tube of the substantially closed and laterally-oriented intermediate disk of the hollow and cylindrically-shaped body of the cap portion.

Yet still another object of the present invention is to provide a dual compartment squeezable dispensing container wherein the selection means further includes a first 90 degree sector-shaped throughbore that provides a clearance for receiving a finger of a user when the finger of the user presses downwardly on the first small pressing portion of the first pivotable and semi-circular-shaped cover of the cap portion to open the hollow and cylindrically-shaped tube of the substantially closed and laterally-oriented intermediate disk of the hollow and cylindrically-shaped body of the cap portion.

Still yet another object of the present invention is to provide a dual compartment squeezable dispensing container wherein the first 90 degree sector-shaped throughbore of the selection means is disposed in the cylindrically-shaped longitudinal side of the hollow and cylindrically-shaped body of the cap portion and opens into the first semi-cylindrically-shaped compartment of the hollow and cylindrically-shaped body of the cap portion and whose one straight side is coincident with one end of the longitudinally-disposed and rectangular-shaped partition of the hollow and cylindrically-shaped body of the cap portion, whose other straight side opens into and is coincident with the open and circular-shaped top of the hollow and cylindrically-shaped body of the cap portion, and whose arcuate-shaped side extends therebetween.

Yet still another object of the present invention is to provide a dual compartment squeezable dispensing container wherein the arcuate-shaped side of the first 90 degree sector-shaped throughbore of the selection means is upwardly and inwardly tapering, so that injury to the finger of the user when the first small pressing portion of the first pivotable and semi-circular-shaped cover of the cap portion is pivoted all the way downward is prevented.

Still yet another object of the present invention is to provide a dual compartment squeezable dispensing container wherein the selection means includes a second pivotable and semi-circular-shaped cover that is pivotally mounted to the hollow and cylindrically-shaped body of the cap portion by a second pivot pin and selectively opens and closes that portion of the open and circular-shaped top of the hollow and cylindrically-shaped body of the cap portion that defines the top of the second semi-cylindrically-shaped compartment of the hollow and cylindrically-shaped body of the cap portion.

Yet still another object of the present invention is to provide a dual compartment squeezable dispensing container wherein the selected speed of the other fluid component of the second generally semi-cylindrically-shaped compartment of the hollow and generally cylindrically-shaped body of the container portion being dispensed therefrom is achieved by varying an amount that the second pivotable and semi-circular-shaped cover of the cap portion is opened.

Still yet another object of the present invention is to provide a dual compartment squeezable dispensing container wherein the second pivot pin of the second pivotable and semi-circular-shaped cover of the cap portion pivotally enters the cylindrically-shaped longitudinal side of the hollow and cylindrically-shaped body of the cap portion and pivotally enters perpendicularly the longitudinally-disposed and rectangular-shaped partition of the hollow and cylindrically-shaped body of the cap portion in a direction of an imaginary line drawn through the center point of the uppermost end of the first hollow and cylindrically-shaped tube of the substantially closed and laterally-oriented intermediate disk of the hollow and cylindrically-shaped body of the cap portion.

Yet still another object of the present invention is to provide a dual compartment squeezable dispensing container wherein the second pivot pin of the second pivotable and semi-circular-shaped cover of the cap portion divides the second pivotable and semi-circular-shaped cover into a second large sealing portion that has a lower surface and extends over and selectively opens and closes the uppermost end of the second hollow and cylindrically-shaped tube of the substantially closed and laterally-oriented intermediate disk of the hollow and cylindrically-shaped body of the cap portion while providing a reflective surface for achieving the selected direction of the other fluid component of the second generally semi-cylindrically-shaped compartment of the hollow and generally cylindrically-shaped body of the container portion being dispensed therefrom, and a second small pressing portion that is smaller than the second large sealing portion of the second pivotable and semi-circular-shaped cover of the cap portion, as a result of positioning of the second cover pivot pin of the second pivotable and semi-circular-shaped cover of the cap portion.

Still yet another object of the present invention is to provide a dual compartment squeezable dispensing container wherein the lower surface of the second large sealing portion of the second pivotable and semi-circular-shaped cover of the cap portion has a sealing ring disposed thereon to assure a positive seal with the uppermost end of the second hollow and cylindrically-shaped tube of the substantially closed and laterally-oriented intermediate disk of the hollow and cylindrically-shaped body of the cap portion.

Yet still another object of the present invention is to provide a dual compartment squeezable dispensing container wherein the selection means further includes a second 90 degree sector-shaped throughbore that provides a clearance for receiving a finger of a user when the finger of the user presses downwardly on the second small pressing portion of the second pivotable and semi-circular-shaped cover of the cap portion to open the second hollow and cylindrically-shaped tube of the substantially closed and laterally-oriented intermediate disk of the hollow and cylindrically-shaped body of the cap portion.

Still yet another object of the present invention is to provide a dual compartment squeezable dispensing container wherein the second 90 degree sector-shaped throughbore of the selection means is disposed in the cylindrically-shaped longitudinal side of the hollow and cylindrically-shaped body of the cap portion and opens into the second semi-cylindrically-shaped compartment of the hollow and cylindrically-shaped body of the cap portion and whose one straight side is coincident with an opposite end of the longitudinally-disposed and rectangular-shaped partition of the hollow and cylindrically-shaped body of the cap portion, whose other straight side opens into and is coincident with the open and circular-shaped top of the hollow and cylindrically-shaped body of the cap portion, and whose arcuate-shaped side extends therebetween.

Finally, yet still another object of the present invention is to provide a dual compartment squeezable dispensing container wherein the arcuate-shaped side of the second 90 degree sector-shaped throughbore of the selection means is upwardly and inwardly tapering, so that injury to the finger of the user when the second small pressing portion of the second pivotable and semi-circular-shaped cover of the cap portion is pivoted all the way downward is prevented.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
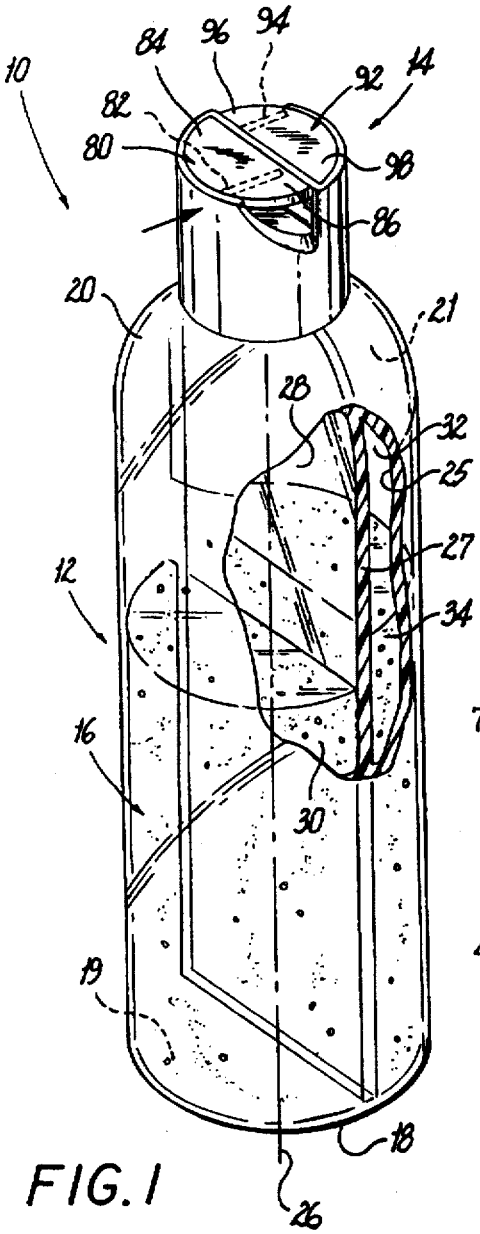
FIG. 1 is a diagrammatic perspective view of the present invention with parts cut away.

10 dual compartment squeezable dispensing container of the present invention
12 container portion
14 cap portion
16 container portion hollow and generally cylindrically-shaped body
18 container portion body closed and generally circular-shaped bottom
19 container portion body closed and generally circular-shaped bottom interior surface
20 container portion body substantially closed and generally hemispherically-shaped top
21 container portion body top generally hemispherically-shaped interior surface
22 container portion body top centrally-disposed and circular-shaped throughbore
24 container portion body generally cylindrically-shaped longitudinal side
25 container portion body generally cylindrically-shaped longitudinal side interior surface
26 container portion body longitudinal axis
27 container portion body longitudinally-disposed and generally rectangular-shaped partition
28 container portion body first generally semi-cylindrically-shaped compartment
30 container portion body first compartment fluid component
32 container portion body second generally semi-cylindrically-shaped compartment
34 container portion body second compartment fluid component
36 container portion hollow and cylindrically-shaped neck
38 container portion neck opened and circular-shaped bottom
40 container portion neck substantially closed and circular-shaped top
41 container portion neck top circular-shaped interior surface
42 container portion neck top first offset and circular-shaped throughbore
44 container portion neck top second offset and circular-shaped throughbore
46 container portion neck cylindrically-shaped longitudinal side
47 container portion neck cylindrically-shaped longitudinal side interior surface
48 container portion neck top radially-outwardly-extending, circumferentially-disposed, and circular-shaped lip
50 container portion neck longitudinal axis
52 container portion neck longitudinally-disposed and generally rectangular-shaped partition
54 container portion neck first generally semi-cylindrically-shaped compartment
56 container portion neck second generally semi-cylindrically-shaped compartment
58 cap portion hollow and cylindrically-shaped body
60 cap portion body open and circular-shaped bottom
62 cap portion body open and circular-shaped top
64 cap portion body cylindrically-shaped longitudinal side
66 cap portion body cylindrically-shaped longitudinal side interior surface
68 cap portion body longitudinal axis
70 cap portion body substantially closed and laterally-oriented intermediate disk
72 cap portion body longitudinally-disposed and rectangular-shaped partition
73 cap portion body first semi-cylindrically-shaped compartment
74 cap portion body intermediate disk first offset and circular-shaped throughbore
75 cap portion body intermediate disk first hollow and cylindrically-shaped tube
76 cap portion body intermediate disk second offset and circular-shaped throughbore
77 cap portion body second semi-cylindrically-shaped compartment 78 cap portion body intermediate disk second hollow and cylindrically-shaped tube
80 cap portion first pivotable and semi-circular-shaped cover
82 cap portion first cover pivot pin
84 cap portion first cover large sealing portion
86 cap portion first cover small pressing portion
88 cap portion first cover sealing portion lower surface sealing ring
90 cap portion body longitudinal side first 90 degree sector-shaped throughbore
92 cap portion second pivotable and semi-circular-shaped cover
94 cap portion second cover pivot pin
96 cap portion second cover large sealing portion
98 cap portion second cover small pressing portion
100 cap portion second cover sealing portion lower surface sealing ring
102 cap portion body longitudinal side second 90 degree sector-shaped throughbore

DETAILED DESCRIPTION OF THE PREFERRED EMBODIMENT

Referring now to the figures in which like numerals indicate like parts, and particularly to FIG. 1, the dual compartment squeezable dispensing container of the present invention is shown generally at 10 and includes a container portion 12, and a cap portion 14 that is replaceably attached to the container portion 12.

The configuration of the container portion 12 can best be seen in FIGS. 1 and 2, and as such will be discussed with reference thereto.

The container portion 12 includes a container portion hollow and generally cylindrically-shaped body 16 that has a container portion body closed and generally circular-shaped bottom 18 with a container portion body closed and generally circular-shaped bottom interior surface 19, a container portion body substantially closed and generally hemispherically-shaped top 20 with a container portion body top generally hemispherically-shaped interior surface 21 and a container portion body top centrally-disposed and circular-shaped throughbore 22 that extends centrally therethrough, a container portion body generally cylindrically-shaped longitudinal side 24 that has a container portion body generally cylindrically-shaped longitudinal side interior surface 25 and extends from the perimeter of the container portion body closed and generally circular-shaped bottom 18 of the container portion hollow and generally cylindrically-shaped body 16 of the container portion 12 to the perimeter of the container portion body substantially closed and generally hemispherically-shaped top 20 of the container portion hollow and generally cylindrically-shaped body 16 of the container portion 12, and a container portion body longitudinal axis 26 that extends longitudinally centrally through the center of the container portion body top centrally-disposed and circular-shaped throughbore 22 of the container portion body substantially closed and generally hemispherically-shaped top 20 of the container portion hollow and generally cylindrically-shaped body 16 of the container portion 12.

The container portion hollow and generally cylindrically-shaped body 16 of the container portion 12 further has a container portion body longitudinally-disposed and generally rectangular-shaped partition 27 that extends along the container portion body longitudinal axis 26 of the container portion hollow and generally cylindrically-shaped body 16 of the container portion 12 from the container portion body closed and generally circular-shaped bottom interior surface 19 of the container portion body closed and generally circular-shaped bottom 18 of the container portion hollow and generally cylindrically-shaped body 16 of the container portion 12 to the container portion body top and generally hemispherically-shaped interior surface 21 of the container portion body substantially closed and generally hemispherically-shaped top 20 of the container portion hollow and generally cylindrically-shaped body 16 of the container portion 12 and across the container portion body generally cylindrically-shaped longitudinal side interior surface 25 of the container portion body generally cylindrically-shaped longitudinal side 24 of the container portion hollow and generally cylindrically-shaped body 16 of the container portion 12.

The container portion longitudinally-disposed and generally rectangular-shaped partition 27 of the container portion hollow and generally cylindrically-shaped body 16 of the container portion 12 divides the container portion hollow and generally cylindrically-shaped body 16 of the container portion 12 into a container portion body first generally semi-cylindrically-shaped compartment 28 that contains a container portion body first compartment fluid component 30 and a container portion body second generally semi-cylindrically-shaped compartment 32 that contains a container portion body second compartment fluid component 34.

Figure 2:
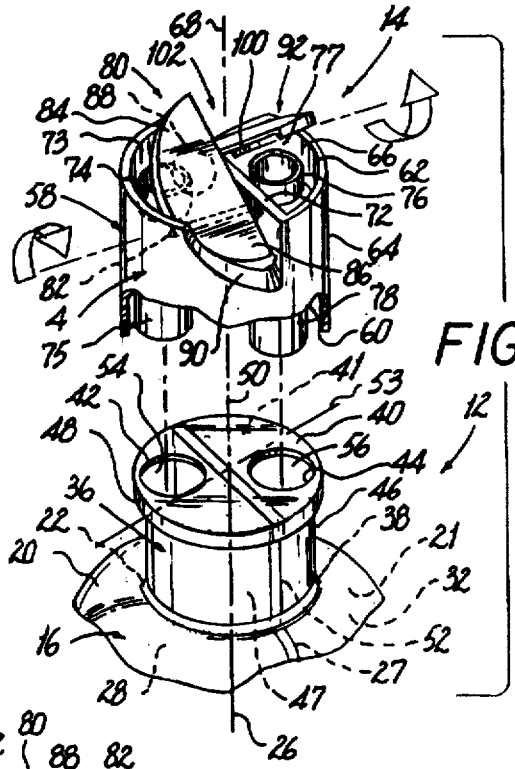
FIG. 2 is a diagrammatic exploded perspective view of the cap portion with parts cut away and separated from the bottle portion, illustrating both covers in an open position.
Figure 3:
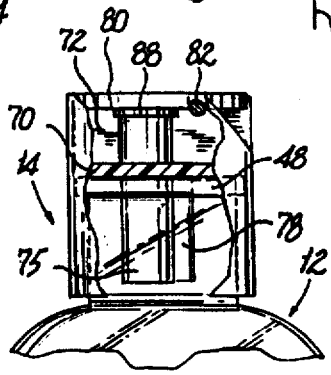
FIG. 3 is a diagrammatic side elevational view taken in the direction of arrow 3 in FIG. 1 of the cap portion, with parts cut away, illustrating both covers in a closed position.
Figure 4:
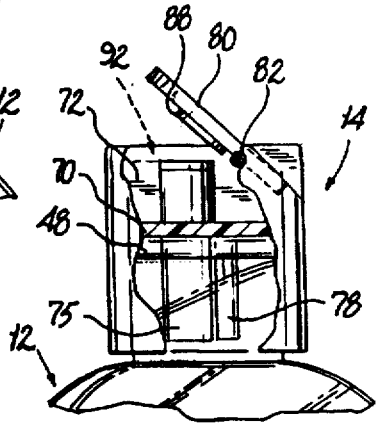
FIG. 4 is a diagrammatic side elevational view taken in the direction of arrow 4 in FIG. 1 of the cap portion, with parts cut away, illustrating a first cover in a closed position and a second cover in an opened position.

As shown in FIG. 2, the container portion 12 further includes a container portion hollow and cylindrically-shaped neck 36.

The container portion hollow and cylindrically-shaped neck 36 of the container portion 12 has a container portion neck opened and circular-shaped bottom 38 that is integral with, and extends perpendicularly upwardly from, the perimeter of the container portion body top centrally-disposed and circular-shaped throughbore 22 of the container portion body substantially closed and generally hemispherically-shaped top 20 of the container portion hollow and generally cylindrically-shaped body 16 of the container portion 12.

The container portion hollow and cylindrically-shaped neck 36 of the container portion 12 further has a container portion neck substantially closed and circular-shaped top 40 with a container portion neck top circular-shaped interior surface 41, a container portion neck top first offset and circular-shaped throughbore 42 that extends therethrough, and a container portion neck top second offset and circular-shaped throughbore 44 that extends therethrough opposite to, and offset from, the container portion neck top first offset and circular-shaped throughbores 42 of the container portion neck substantially closed and circular-shaped top 40 of the container portion hollow and cylindrically-shaped neck 36 of the container portion 12.

The container portion hollow and cylindrically-shaped neck 36 of the container portion 12 further has a container portion neck cylindrically-shaped longitudinal side 46 with a container portion neck cylindrically-shaped longitudinal side interior surface 47 and which extends from the perimeter of the container portion neck open and circular-shaped bottom 38 of the container portion hollow and cylindrically-shaped neck 36 of the container portion 12 to the perimeter of the container portion body substantially closed and circular-shaped top 40 of the container portion hollow and cylindrically-shaped neck 36 of the container portion 12.

The container portion neck substantially closed and circular-shaped top 40 of the container portion hollow and cylindrically-shaped neck 36 of the container portion 12 extends slightly radially outwardly from the container portion neck cylindrically-shaped longitudinal side 46 of the container portion hollow and cylindrically-shaped neck 36 of the container portion 12 so as to form a container portion neck top radially-outwardly-extending, circumferentially-disposed, and circular-shaped lip 48 therearound.

The container portion neck top radially-outwardly-extending, circumferentially-disposed, and circular-shaped lip 48 of the container portion neck substantially closed and circular-shaped top 40 of the container portion hollow and cylindrically-shaped neck 36 of the container portion 12 provides frictional engagement with the cap portion 14 when replaceably attached thereon.

It is to be understood, however, that the cap portion 14 and the container portion hollow and cylindrically-shaped neck 36 of the container portion 12 can be so constructed so that the cap portion 14 can be replaceably threadably attached to the container portion hollow and cylindrically-shaped neck 36 of the container portion 12 without departing in any way from the spirit of the present invention.

The container portion hollow and cylindrically-shaped neck 36 of the container portion 12 further has a container portion neck longitudinal axis 50 that is collinear with the container portion body longitudinal axis 26 of the container portion hollow and generally cylindrically-shaped body 16 of the container portion 12.

The container portion hollow and cylindrically-shaped neck 36 of the container portion 12 further has a container portion neck longitudinally-disposed and generally rectangular-shaped partition 52 that is integral with, and extends coplanarly-upwardly from the container portion body longitudinally-disposed and generally rectangular-shaped partition 27 of the container portion 12 along the container portion neck longitudinal axis 50 of the container portion hollow and cylindrically-shaped neck 36 of the container portion 12 to the container portion neck top circular-shaped interior surface 41 of the container portion neck substantially closed and circular-shaped top 40 of the container portion hollow and cylindrically-shaped neck 36 of the container portion 12 and across the container portion neck cylindrically-shaped longitudinal side interior surface 47 of the container portion neck cylindrically-shaped longitudinal side 46 of the container portion hollow and cylindrically-shaped neck 36 of the container portion 12.

The container portion neck top first offset and circular-shaped throughbore 42 of the container portion neck substantially closed and circular-shaped top 40 of the container portion hollow and cylindrically-shaped neck 36 of the container portion 12 is positioned adjacent to one side of the container portion neck longitudinally-disposed and generally rectangular-shaped partition 52 of the container portion hollow and cylindrically-shaped neck 36 of the container portion 12 and adjacent to one side of a container portion neck partition perpendicular bisector 53 of the container portion neck longitudinally-disposed and generally rectangular-shaped partition 52 of the container portion hollow and cylindrically-shaped neck 36 of the container portion 12.

The container portion neck top second offset and circular-shaped throughbore 44 of the container portion neck substantially closed and circular-shaped top 40 of the container portion hollow and cylindrically-shaped neck 36 of the container portion 12 is positioned adjacent to the opposite side of the container portion neck longitudinally-disposed and generally rectangular-shaped partition 52 of the container portion hollow and cylindrically-shaped neck 36 of the container portion 12 and adjacent to the other side of the container portion neck partition perpendicular bisector 53 of the container portion neck longitudinally-disposed and generally rectangular-shaped partition 52 of the container portion hollow and cylindrically-shaped neck 36 of the container portion 12.

The container portion neck longitudinally-disposed and generally rectangular-shaped partition 52 of the container portion hollow and cylindrically-shaped neck 36 of the container portion 12 divides the container portion hollow and cylindrically-shaped neck 36 of the container portion 12 into a container portion neck first generally semi-cylindrically-shaped compartment 54 that is in fluid communication with both the container portion body first generally semi-cylindrically-shaped compartment 28 of the container portion hollow and generally cylindrically-shaped body 16 of the container portion 12 and the container portion neck top first offset and circular-shaped throughbore 42 of the container portion neck substantially closed and circular-shaped top 40 of the container portion hollow and cylindrically-shaped neck 36 of the container portion 12, and into a container portion neck second generally semi-cylindrically-shaped compartment 56 that is in fluid communication with both the container portion body second generally semi-cylindrically-shaped compartment 32 of the container portion hollow and generally cylindrically-shaped body 16 of the container portion 12 and the container portion neck top second offset and circular-shaped throughbore 44 of the container portion neck substantially closed and circular-shaped top 40 of the container portion hollow and cylindrically-shaped neck 36 of the container portion 12.

The configuration of the cap portion 14 can best be seen in FIGS. 1–4, and as such will be discussed with reference thereto.

The cap portion 14 includes a cap portion hollow and cylindrically-shaped body 58 that has a cap portion body open and circular-shaped bottom 60, a cap portion body open and circular-shaped top 62, a cap portion body cylindrically-shaped longitudinal side 64 with a cap portion body cylindrically-shaped longitudinal side interior surface 66 and which extends from the perimeter of the cap portion body open and circular-shaped bottom 60 of the cap portion hollow and cylindrically-shaped body 58 of the cap portion 14 to the perimeter of the cap portion body open and circular-shaped top 62 of the cap portion hollow and cylindrically-shaped body 58 of the cap portion 14, and a cap portion body longitudinal axis 68 that is collinear with the container portion neck longitudinal axis 50 of the container portion hollow and cylindrically-shaped neck 36 of the container portion 12.

The cap portion hollow and cylindrically-shaped body 58 of the cap portion 14 further has a cap portion body substantially closed and laterally-oriented intermediate disk 70 that sits on the container portion neck substantially closed and circular-shaped top 40 of the container portion hollow and cylindrically-shaped neck 36 of the container portion 12 and is disposed intermediate, and substantially parallel to, the cap portion body open and circular-shaped bottom 60 of the cap portion hollow and cylindrically-shaped body 58 of the cap portion 14 and the cap portion body open and circular-shaped top 62 of the cap portion hollow and cylindrically-shaped body 58 of the cap portion 14 and whose perimeter is coincident with the cap portion body cylindrically-shaped longitudinal side interior surface 66 of the cap portion body cylindrically-shaped longitudinal side 64 of the cap portion hollow and cylindrically-shaped body 58 of the cap portion 14.

The cap portion hollow and cylindrically-shaped body 58 of the cap portion 14 further has a cap portion body longitudinally-disposed and rectangular-shaped partition 72 that extends along the cap portion body longitudinal axis 68 of the cap portion hollow and cylindrically-shaped body 58 of the cap portion 14 perpendicularly upwardly from a diameter of the cap portion body substantially closed and laterally-oriented intermediate disk 70 of the cap portion hollow and cylindrically-shaped body 58 of the cap portion 14 to the cap portion body open and circular-shaped top 62 of the cap portion hollow and cylindrically-shaped body 58 of the cap portion 14 and across the cap portion body cylindrically-shaped longitudinal side interior surface 66 of the cap portion body cylindrically-shaped longitudinal side 64 of the cap portion hollow and cylindrically-shaped body 58 of the cap portion 14.

The cap portion body longitudinally-disposed and rectangular-shaped partition 72 of the cap portion hollow and cylindrically-shaped body 58 of the cap portion 14 is co-planar, and in vertical alignment with, the container portion neck longitudinally-disposed and generally rectangular-shaped partition 52 of the container portion hollow and cylindrically-shaped neck 36 of the container portion 12 and divides the cap portion hollow and cylindrically-shaped body 58 of the cap portion 14 into a cap portion body first semi-cylindrically-shaped compartment 73 and a cap portion body second semi-cylindrically-shaped compartment 77.

The cap portion body substantially closed and laterally-oriented intermediate disk 70 of the cap portion hollow and cylindrically-shaped body 58 of the cap portion 14 has a cap portion body intermediate disk first offset and circular-shaped throughbore 74 that is positioned adjacent to one side of the cap portion body longitudinally-disposed and rectangular-shaped partition 72 of the cap portion hollow and cylindrically-shaped body 58 of the cap portion 14, in the cap portion body first semi-cylindrically-shaped compartment 73 of the cap portion hollow and cylindrically-shaped body 58 of the cap portion 14, and in vertical alignment with the container portion neck top first offset and circular-shaped throughbore 42 of the container portion neck substantially closed and circular-shaped top 40 of the container portion hollow and cylindrically-shaped neck 36 of the container portion 12.

The cap portion body substantially closed and laterally-oriented intermediate disk 70 of the cap portion hollow and cylindrically-shaped body 58 of the cap portion 14 further has a cap portion body intermediate disk first hollow and cylindrically-shaped tube 75 that passes perpendicularly through the cap portion body intermediate disk first offset and circular-shaped throughbore 74 of the cap portion body substantially closed and laterally-oriented intermediate disk 70 of the cap portion hollow and cylindrically-shaped body 58 of the cap portion 14.

The cap portion body intermediate disk first hollow and cylindrically-shaped tube 75 of the cap portion body substantially closed and laterally-oriented intermediate disk 70 of the cap portion hollow and cylindrically-shaped body 58 of the cap portion 14 extends from slightly below the cap portion body open and circular-shaped top 62 of the cap portion hollow and cylindrically-shaped body 58 of the cap portion 14 to slightly above the cap portion body open and circular-shaped bottom 60 of the cap portion hollow and cylindrically-shaped body 58 of the cap portion 14 and replaceably and sealingly enters the container portion neck top first offset and circular-shaped throughbore 42 of the container portion neck substantially closed and circular-shaped top 40 of the container portion hollow and cylindrically-shaped neck 36 of the container portion 12 where it is in fluid communication with the container portion neck first generally semi-cylindrically-shaped compartment 54 of the container portion hollow and cylindrically-shaped neck 36 of the container portion 12.

The cap portion body substantially closed and laterally-oriented intermediate disk 70 of the cap portion hollow and cylindrically-shaped body 58 of the cap portion 14 further has a cap portion body intermediate disk second offset and circular-shaped throughbore 76 that is positioned adjacent to the opposite side of the cap portion body longitudinally-disposed and rectangular-shaped partition 72 of the cap portion hollow and cylindrically-shaped body 58 of the cap portion 14, in the cap portion body second semi-cylindrically-shaped compartment 77 of the cap portion hollow and cylindrically-shaped body 58 of the cap portion 14, and in vertical alignment with the container portion neck top second offset and circular-shaped throughbore 44 of the container portion neck substantially closed and circular-shaped top 40 of the container portion hollow and cylindrically-shaped neck 36 of the container portion 12.

The cap portion body substantially closed and laterally-oriented intermediate disk 70 of the cap portion hollow and cylindrically-shaped body 58 of the cap portion 14 further has a cap portion body intermediate disk second hollow and cylindrically-shaped tube 78 that passes perpendicularly through the cap portion body intermediate disk second offset and circular-shaped throughbore 76 of the cap portion body substantially closed and laterally-oriented intermediate disk 70 of the cap portion hollow and cylindrically-shaped body 58 of the cap portion 14.

The cap portion body intermediate disk second hollow and cylindrically-shaped tube 78 of the cap portion body substantially closed and laterally-oriented intermediate disk 70 of the cap portion hollow and cylindrically-shaped body 58 of the cap portion 14 extends from slightly below the cap portion body open and circular-shaped top 62 of the cap portion hollow and cylindrically-shaped body 58 of the cap portion 14 to slightly above the cap portion body open and circular-shaped bottom 60 of the cap portion hollow and cylindrically-shaped body 58 of the cap portion 14 and replaceably and sealingly enters the container portion neck top second offset and circular-shaped throughbore 44 of the container portion neck substantially closed and circular-shaped top 40 of the container portion hollow and cylindrically-shaped neck 36 of the container portion 12 where it is in fluid communication with the container portion neck second generally semi-cylindrically-shaped compartment 56 of the container portion hollow and cylindrically-shaped neck 36 of the container portion 12.

The portion of the cap portion body open and circular-shaped top 62 of the cap portion hollow and cylindrically-shaped body 58 of the cap portion 14 that defines the top of the cap portion body first semi-cylindrically-shaped compartment 73 of the cap portion hollow and cylindrically-shaped body 58 of the cap portion 14 is selectively opened and closed by a cap portion first pivotable and semi-circular-shaped cover 80 that is pivotally mounted to the cap portion hollow and cylindrically-shaped body 58 of the cap portion 14 by a cap portion first cover pivot pin 82.

The cap portion first cover pivot pin 82 of the cap portion first pivotable and semi-circular-shaped cover 80 of the cap portion 14 pivotally enters the cap portion body cylindrically-shaped longitudinal side 64 of the cap portion hollow and cylindrically-shaped body 58 of the cap portion 14 and pivotally enters the cap portion body longitudinally-disposed and rectangular-shaped partition 72 of the cap portion hollow and cylindrically-shaped body 58 of the cap portion 14 in a direction of an imaginary line drawn through the center point of the uppermost end of the cap portion body intermediate disk second hollow and cylindrically-shaped tube 78 of the cap portion body substantially closed and laterally-oriented intermediate disk 70 of the cap portion hollow and cylindrically-shaped body 58 of the cap portion 14 that is perpendicular to the cap portion body longitudinally-disposed and rectangular-shaped partition 72 of the cap portion hollow and cylindrically-shaped body 58 of the cap portion 14.

The cap portion first cover pivot pin 82 of the cap portion first pivotable and semi-circular-shaped cover 80 of the cap portion 14 divides the cap portion first pivotable and semi-circular-shaped cover 80 into a cap portion first cover large sealing portion 84 that extends over and selectively seals the uppermost end of the cap portion body intermediate disk first hollow and cylindrically-shaped tube 75 of the cap portion body substantially closed and laterally-oriented intermediate disk 70 of the cap portion hollow and cylindrically-shaped body 58 of the cap portion 14, and a cap portion first cover small pressing portion 86 that is smaller than the cap portion first cover large sealing portion 84 of the cap portion first pivotable and semi-circular-shaped cover 80 of the cap portion 14, as a result of the positioning of the cap portion first cover pivot pin 82 of the cap portion first pivotable and semi-circular-shaped cover 80 of the cap portion 14.

The lower surface of the cap portion first cover large sealing portion 84 of the cap portion first pivotable and semi-circular-shaped cover 80 of the cap portion 14 has a cap portion first cover sealing portion lower surface sealing ring 88 to assure a positive seal.

The cap portion body cylindrically-shaped longitudinal side 64 of the cap portion hollow and cylindrically-shaped body 58 of the cap portion 14 has a cap portion body longitudinal side first 90 degree sector-shaped throughbore 90 that opens into the cap portion body first semi-cylindrically-shaped compartment 73 of the cap portion hollow and cylindrically-shaped body 58 of the cap portion 14 and whose first straight side is coincident with one end of the cap portion body longitudinally-disposed and rectangular-shaped partition 72 of the cap portion hollow and cylindrically-shaped body 58 of the cap portion 14, whose other straight side opens into and is coincident with the cap portion body open and circular-shaped top 62 of the cap portion hollow and cylindrically-shaped body 58 of the cap portion 14, and whose arcuate-shaped side is upwardly-inwardly-tapering and extends therebetween.

The cap portion body longitudinal side first 90 degree sector-shaped throughbore 90 of the cap portion body cylindrically-shaped longitudinal side 64 of the cap portion hollow and cylindrically-shaped body 58 of the cap portion 14 provides a clearance for receiving the finger of the user when the finger of the user presses downwardly on the cap portion first cover small pressing portion 86 of the cap portion first pivotable and semi-circular-shaped cover 80 of the cap portion 14 to open the cap portion body intermediate disk first hollow and cylindrically-shaped tube 75 of the cap portion body substantially closed and laterally-oriented intermediate disk 70 of the cap portion hollow and cylindrically-shaped body 58 of the cap portion 14.

The upwardly and inwardly tapering of the arcuate-shaped side of the cap portion body longitudinal side first 90 degree sector-shaped throughbore 90 of the cap portion body cylindrically-shaped longitudinal side 64 of the cap portion hollow and cylindrically-shaped body 58 of the cap portion 14 prevents injury to the finger of the user when the cap portion first cover small pressing portion 86 of the cap portion first pivotable and semi-circular-shaped cover 80 of the cap portion 14 is pivoted all the way downward.

The pivotability of the cap portion first pivotable and semi-circular-shaped cover 80 of the cap portion 14 provides numerous advantages functions.

Firstly, the cap portion first pivotable and semi-circular-shaped cover 80 of the cap portion 14 selectively opens and closes the cap portion body intermediate disk first hollow and cylindrically-shaped tube 75 of the cap portion body substantially closed and laterally-oriented intermediate disk 70 of the cap portion hollow and cylindrically-shaped body 58 of the cap portion 14.

Secondly, the cap portion first pivotable and semi-circular-shaped cover 80 of the cap portion 14 regulates the speed of the container portion body first compartment fluid component 30 of the container portion body first generally semi-cylindrically-shaped compartment 28 of the container portion hollow and generally cylindrically-shaped body 16 of the container portion 12 being dispensed therefrom by the amount that the cap portion first pivotable and semi-circular-shaped cover 80 of the cap portion 14 is opened.

And, thirdly but not finally, the cap portion first pivotable and semi-circular-shaped cover 80 of the cap portion 14 selectively directs the container portion body first compartment fluid component 30 of the container portion body first generally semi-cylindrically-shaped compartment 28 of the container portion hollow and generally cylindrically-shaped body 16 of the container portion 12 being dispensed therefrom by providing a selectively directed internal surface for reflecting the container portion body first compartment fluid component 30 of the container portion body first generally semi-cylindrically-shaped compartment 28 of the container portion hollow and generally cylindrically-shaped body 16 of the container portion 12 in the desired direction.

The portion of the cap portion body open and circular-shaped top 62 of the cap portion hollow and cylindrically-shaped body 58 of the cap portion 14 that defines the top of the cap portion body second semi-cylindrically-shaped compartment 77 of the cap portion hollow and cylindrically-shaped body 58 of the cap portion 14 is selectively opened and closed by a cap portion second pivotable and semi-circular-shaped cover 92 that is pivotally mounted to the cap portion hollow and cylindrically-shaped body 58 of the cap portion 14 by a cap portion second cover pivot pin 94.

The cap portion second cover pivot pin 94 of the cap portion second pivotable and semi-circular-shaped cover 92 of the cap portion 14 pivotally enters the cap portion body cylindrically-shaped longitudinal side 64 of the cap portion hollow and cylindrically-shaped body 58 of the cap portion 14 and pivotally enters the cap portion body longitudinally-disposed and rectangular-shaped partition 72 of the cap portion hollow and cylindrically-shaped body 58 of the cap portion 14 in a direction of an imaginary line drawn through the center point of the uppermost end of the cap portion body intermediate disk first hollow and cylindrically-shaped tube 75 of the cap portion body substantially closed and laterally-oriented intermediate disk 70 of the cap portion hollow and cylindrically-shaped body 58 of the cap portion 14 that is perpendicular to the cap portion body longitudinally-disposed and rectangular-shaped partition 72 of the cap portion hollow and cylindrically-shaped body 58 of the cap portion 14.

The cap portion second cover pivot pin 94 of the cap portion second pivotable and semi-circular-shaped cover 92 of the cap portion 14 divides the cap portion second pivotable and semi-circular-shaped cover 92 into a cap portion second cover large sealing portion 96 that extends over and selectively seals the uppermost end of the cap portion body intermediate disk second hollow and cylindrically-shaped tube 78 of the cap portion body substantially closed and laterally-oriented intermediate disk 70 of the cap portion hollow and cylindrically-shaped body 58 of the cap portion 14, and a cap portion second cover small pressing portion 98 that is smaller than the cap portion second cover large sealing portion 96 of the cap portion second pivotable and semi-circular-shaped cover 92 of the cap portion 14, as a result of the positioning of the cap portion second cover pivot pin 94 of the cap portion second pivotable and semi-circular-shaped cover 92 of the cap portion 14.

The lower surface of the cap portion second cover large sealing portion 96 of the cap portion second pivotable and semi-circular-shaped cover 92 of the cap portion 14 has a cap portion second cover sealing portion lower surface sealing ring 100 to assure a positive seal.

The cap portion body cylindrically-shaped longitudinal side 64 of the cap portion hollow and cylindrically-shaped body 58 of the cap portion 14 has a cap portion body longitudinal side second 90 degree sector-shaped throughbore 102 that opens into the cap portion body second semi-cylindrically-shaped compartment 77 of the cap portion hollow and cylindrically-shaped body 58 of the cap portion 14 and whose first straight side is coincident with the other end of the cap portion body longitudinally-disposed and rectangular-shaped partition 72 of the cap portion hollow and cylindrically-shaped body 58 of the cap portion 14, whose other straight side opens into and is coincident with cap portion body open and circular-shaped top 62 of the cap portion hollow and cylindrically-shaped body 58 of the cap portion 14, and whose arcuate-shaped side is upwardly-inwardly-tapering and extends therebetween.

The cap portion body longitudinal side second 90 degree sector-shaped throughbore 102 of the cap portion body cylindrically-shaped longitudinal side 64 of the cap portion hollow and cylindrically-shaped body 58 of the cap portion 14 provides a clearance for receiving the finger of the user when the finger of the user presses downwardly on the cap portion second cover small pressing portion 96 of the cap portion second pivotable and semi-circular-shaped cover 92 of the cap portion 14 to open the cap portion body intermediate disk second hollow and cylindrically-shaped tube 78 of the cap portion body substantially closed and laterally-oriented intermediate disk 70 of the cap portion hollow and cylindrically-shaped body 58 of the cap portion 14.

The upwardly and inwardly tapering of the arcuate-shaped side of the cap portion body longitudinal side second 90 degree sector-shaped throughbore 102 of the cap portion body cylindrically-shaped longitudinal side 64 of the cap portion hollow and cylindrically-shaped body 58 of the cap portion 14 prevents injury to the finger of the user when the cap portion second cover small pressing portion 96 of the cap portion second pivotable and semi-circular-shaped cover 92 of the cap portion 14 is pivoted all the way downward.

The pivotability of the cap portion second pivotable and semi-circular-shaped cover 92 of the cap portion 14 provides numerous advantages functions.

Firstly, the cap portion second pivotable and semi-circular-shaped cover 92 of the cap portion 14 selectively opens and closes the cap portion body intermediate disk second hollow and cylindrically-shaped tube 78 of the cap portion body substantially closed and laterally-oriented intermediate disk 70 of the cap portion hollow and cylindrically-shaped body 58 of the cap portion 14.

Secondly, the cap portion second pivotable and semi-circular-shaped cover 92 of the cap portion 14 regulates the speed of the container portion body second compartment fluid component 34 of the container portion body second generally semi-cylindrically-shaped compartment 32 of the container portion hollow and generally cylindrically-shaped body 16 of the container portion 12 being dispensed therefrom by the amount that the cap portion second pivotable and semi-circular-shaped cover 92 of the cap portion 14 is opened.

And, thirdly but not finally, the cap portion second pivotable and semi-circular-shaped cover 92 of the cap portion 14 selectively directs the container portion body second compartment fluid component 34 of the container portion body second generally semi-cylindrically-shaped compartment 32 of the container portion hollow and generally cylindrically-shaped body 16 of the container portion 12 being dispensed therefrom by providing a selectively directed internal surface for reflecting the container portion body second compartment fluid component 34 of the container portion body second generally semi-cylindrically-shaped compartment 32 of the container portion hollow and generally cylindrically-shaped body 16 of the container portion 12 in the desired direction.

It will be understood that each of the elements described above, or two or more together, may also find a useful application in other types of constructions differing from the types described above.

While the invention has been illustrated and described as embodied in a dual compartment squeezable dispensing container, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A dual compartment squeezable dispensing container that alternatively selectively dispenses independently two separate fluid components at a selected speed and in a selected direction, comprising:

a) a container portion having two separate compartments and containing the two separate fluid components; said container portion including a hollow and generally cylindrically-shaped body having a closed and generally circular-shaped bottom with a circular-shaped interior surface and a perimeter; said hollow and generally cylindrically-shaped body of said container portion further having a substantially closed and generally hemispherically-shaped top with a perimeter, a generally hemispherically-shaped interior surface, and a centrally-disposed and circular-shaped throughbore with a perimeter and a center that extends centrally therethrough; said hollow and generally cylindrically-shaped body of said container portion further having a generally cylindrically-shaped longitudinal side with a generally cylindrically-shaped interior surface extending from said perimeter of said closed and generally circular-shaped bottom of said hollow and generally cylindrically-shaped body of said container portion to said perimeter of said substantially closed and generally hemispherically-shaped top of said hollow and generally cylindrically-shaped body of said container portion; said hollow and generally cylindrically-shaped body of said container portion further having a longitudinal axis extending longitudinally centrally through said center of said centrally-disposed and circular-shaped throughbore of said substantially closed and generally hemispherically-shaped top of said hollow and generally cylindrically-shaped body of said container portion; said hollow and generally cylindrically-shaped body of said container portion further having a longitudinally-disposed and generally rectangular-shaped partition extending along said longitudinal axis of said hollow and generally cylindrically-shaped body of said container portion from said generally circular-shaped interior surface of said closed and generally circular-shaped bottom of said hollow and generally cylindrically-shaped body of said container portion to said generally hemispherically-shaped interior surface of said substantially closed and generally hemispherically-shaped top of said hollow and generally cylindrically-shaped body of said container portion and across said generally cylindrically-shaped interior surface of said generally cylindrically-shaped longitudinal side of said hollow and generally cylindrically-shaped body of said container portion; said longitudinally-disposed and generally rectangular-shaped partition of said hollow and generally cylindrically-shaped body of said container portion dividing said hollow and generally cylindrically-shaped body of said container portion into one of said two separate compartments of said container portion being a first generally semi-cylindrically-shaped compartment containing one of the two separate fluid components and into another one of said two separate compartments of said container portion being a second generally semi-cylindrically-shaped compartment containing another of the two separate fluid components; said container portion further including a hollow and cylindrically-shaped neck; said hollow and cylindrically-shaped neck of said container portion having an opened and circular-shaped bottom with a perimeter and being integral with, and extending perpendicularly upwardly from, said perimeter of said centrally-disposed and circular-shaped throughbore of said substantially closed and generally hemispherically-shaped top of said hollow and generally cylindrically-shaped body of said container portion; said cylindrically-shaped neck of said container portion further having a substantially closed and circular-shaped top with a perimeter, a circular-shaped interior surface, a first offset and circular-shaped throughbore extending therethrough, and a second offset and circular-shaped throughbore extending therethrough opposite to, and offset from, said first offset and circular-shaped throughbore of said substantially closed and circular-shaped top of said hollow and cylindrically-shaped neck of said container portion; said hollow and cylindrically-shaped neck of said container portion further having a cylindrically-shaped longitudinal side with a cylindrically-shaped interior surface extending from said perimeter of said open and circular-shaped bottom of said hollow and cylindrically-shaped neck of said container portion to said perimeter of said substantially closed and circular-shaped top of said hollow and cylindrically-shaped neck of said container portion; said hollow and cylindrically-shaped neck of said container portion further having a longitudinal axis being collinear with said longitudinal axis of said hollow and generally cylindrically-shaped body of said container portion; said hollow and cylindrically-shaped neck of said container portion further having a longitudinally-disposed and generally rectangular-shaped partition being integral with, and extending coplanarly-upwardly from said longitudinally-disposed and generally rectangular-shaped partition of said container portion along said longitudinal axis of said hollow and cylindrically-shaped neck of said container portion to said circular-shaped interior surface of said substantially closed and circular-shaped top of said hollow and cylindrically-shaped neck of said container portion and across said cylindrically-shaped interior surface of said cylindrically-shaped longitudinal side of said hollow and cylindrically-shaped neck of said container portion; said longitudinally-disposed and generally rectangular-shaped partition of said hollow and cylindrically-shaped neck of said container portion dividing said hollow and cylindrically-shaped neck of said container portion into a first generally semi-cylindrically-shaped compartment being in fluid communication with both said first generally semi-cylindrically-shaped compartment of said hollow and generally cylindrically-shaped body of said container portion and said first offset and circular-shaped throughbore of said substantially closed and circular-shaped top of said hollow and cylindrically-shaped neck of said container portion, and into a second generally semi-cylindrically-shaped compartment being in fluid communication with both said second generally semi-cylindrically-shaped compartment of said hollow and generally cylindrically-shaped body of said container portion and said second offset and circular-shaped throughbore of said substantially closed and circular-shaped top of said hollow and cylindrically-shaped neck of said container portion; said first offset and circular-shaped throughbore of said substantially closed and circular-shaped top of said hollow and cylindrically-shaped neck of said container portion being positioned adjacent to one side of said longitudinally-disposed and generally rectangular-shaped partition of said hollow and cylindrically-shaped neck of said container portion and adjacent to one side of an imaginary perpendicular bisector of said longitudinally-disposed and generally rectangular-shaped partition of said hollow and cylindrically-shaped neck of said container portion; said second offset and circular-shaped throughbore of said substantially closed and circular-shaped top of said hollow and cylindrically-shaped neck of said container portion being positioned adjacent to an opposite side of said longitudinally-disposed and generally rectangular-shaped partition of said hollow and cylindrically-shaped neck of said container portion and adjacent to an opposite side of said imaginary perpendicular bisector of said longitudinally-disposed and generally rectangular-shaped partition of said hollow and cylindrically-shaped neck of said container portion;

b) a cap portion being replaceably and securingly attached to said container; said cap portion including a hollow and cylindrically-shaped body having a circular-shaped bottom with a perimeter; said hollow and cylindrically-shaped body of said cap portion further having an open and circular-shaped top with a perimeter; said hollow and cylindrically-shaped body of said cap portion further having a cylindrically-shaped longitudinal side with a cylindrically-shaped interior surface extending from said perimeter of said open and circular-shaped bottom of said hollow and cylindrically-shaped body of said cap portion to said perimeter of said open and circular-shaped top of said hollow and cylindrically-shaped body of said cap portion; said hollow and cylindrically-shaped body of said cap portion further having a longitudinal axis being collinear with said longitudinal axis of said hollow and cylindrically-shaped neck of said container portion; said hollow and cylindrically-shaped body of said cap portion further having a substantially closed and laterally-oriented intermediate disk with a perimeter and replaceable resting on said substantially closed and circular-shaped top of said hollow and cylindrically-shaped neck of said container portion and being disposed intermediate, and substantially parallel to, said open and circular-shaped bottom of said hollow and cylindrically-shaped body of said cap portion and said open and circular-shaped top of said hollow and cylindrically-shaped body of said cap portion; said perimeter of said substantially closed and laterally-oriented intermediate disk of said hollow and cylindrically-shaped body of said cap portion being coincident with said cylindrically-shaped interior surface of said cylindrically-shaped longitudinal side of said hollow and cylindrically-shaped body of said cap portion; and c) selection means associated with said cap portion for alternatively selectively dispensing independently the two separate fluid components at the selected speed and in the selected direction.

2. The container as defined in claim 1, wherein said substantially closed and circular-shaped top of said hollow and cylindrically-shaped neck of said container portion extends slightly radially outwardly from said cylindrically-shaped longitudinal side of said hollow and cylindrically-shaped neck of said container portion so as to form a radially-outwardly-extending, circumferentially-disposed, and circular-shaped lip therearound; said radially-outwardly-extending, circumferentially-disposed, and circular-shaped lip of said substantially closed and circular-shaped top of said hollow and cylindrically-shaped neck of said container portion provides frictional engagement with said cap portion when replaceably secured to said hollow and cylindrically-shaped neck of said container portion.

3. The container as defined in claim 1, wherein said hollow and cylindrically-shaped body of said cap portion further has a longitudinally-disposed and rectangular-shaped partition that extends along said longitudinal axis of said hollow and cylindrically-shaped body of said cap portion perpendicularly upwardly from a diameter of said substantially closed and laterally-oriented intermediate disk of said hollow and cylindrically-shaped body of said cap portion to said open and circular-shaped top of said hollow and cylindrically-shaped body of said cap portion and across said cylindrically-shaped interior surface of said cylindrically-shaped longitudinal side of said hollow and cylindrically-shaped body of said cap portion; said longitudinally-disposed and rectangular-shaped partition of said hollow and cylindrically-shaped body of said cap portion is co-planar, and in vertical alignment with, said longitudinally-disposed and generally rectangular-shaped partition of said hollow and cylindrically-shaped neck of said container portion and divides said hollow and cylindrically-shaped body of said cap portion into a first semi-cylindrically-shaped compartment with an open top and a second semi-cylindrically-shaped compartment with an open top.

4. The container as defined in claim 3, wherein said substantially closed and laterally-oriented intermediate disk of said hollow and cylindrically-shaped body of said cap portion has a first offset and circular-shaped throughbore that is positioned adjacent to one side of said longitudinally-disposed and rectangular-shaped partition of said hollow and cylindrically-shaped body of said cap portion, in said first semi-cylindrically-shaped compartment of said hollow and cylindrically-shaped body of said cap portion, and in vertical alignment with said first offset and circular-shaped throughbore of said substantially closed and circular-shaped top of said hollow and cylindrically-shaped neck of said container portion.

5. The container as defined in claim 4, wherein said substantially closed and laterally-oriented intermediate disk of said hollow and cylindrically-shaped body of said cap portion further has a first hollow and cylindrically-shaped tube that has an uppermost end with a center point and passes perpendicularly through said first offset and circular-shaped throughbore of said substantially closed and laterally-oriented intermediate disk of said hollow and cylindrically-shaped body of said cap portion; said first hollow and cylindrically-shaped tube of said substantially closed and laterally-oriented intermediate disk of said hollow and cylindrically-shaped body of said cap portion extends from slightly below said open and circular-shaped top of said hollow and cylindrically-shaped body of said cap portion to slightly above said open and circular-shaped bottom of said hollow and cylindrically-shaped body of said cap portion and replaceably and sealingly enters said first offset and circular-shaped throughbore of said substantially closed and circular-shaped top of said hollow and cylindrically-shaped neck of said container portion where said first hollow and cylindrically-shaped tube of said substantially closed and laterally-oriented intermediate disk of said hollow and cylindrically-shaped body of said cap portion is in fluid communication with said first generally semi-cylindrically-shaped compartment of said hollow and cylindrically-shaped neck of said container portion.

6. The container as defined in claim 5, wherein said substantially closed and laterally-oriented intermediate disk of said hollow and cylindrically-shaped body of said cap portion further has a second offset and circular-shaped throughbore that is positioned adjacent to an opposite side of said longitudinally-disposed and rectangular-shaped partition of said hollow and cylindrically-shaped body of said cap portion, in said second semi-cylindrically-shaped compartment of said hollow and cylindrically-shaped body of said cap portion, and in vertical alignment with said second offset and circular-shaped throughbore of said substantially closed and circular-shaped top of said hollow and cylindrically-shaped neck of said container portion.

7. The container as defined in claim 6, wherein said substantially closed and laterally-oriented intermediate disk of said hollow and cylindrically-shaped body of said cap portion further has a second hollow and cylindrically-shaped tube that has an uppermost end with a center point and passes perpendicularly through said second offset and circular-shaped throughbore of said substantially closed and laterally-oriented intermediate disk of said hollow and cylindrically-shaped body of said cap portion; said second hollow and cylindrically-shaped tube of said substantially closed and laterally-oriented intermediate disk of said hollow and cylindrically-shaped body of said cap portion extends from slightly below said open and circular-shaped top of said hollow and cylindrically-shaped body of said cap portion to slightly above said open and circular-shaped bottom of said hollow and cylindrically-shaped body of said cap portion and replaceably and sealingly enters said second offset and circular-shaped throughbore of said substantially closed and circular-shaped top of said hollow and cylindrically-shaped neck of said container portion where said second hollow and cylindrically-shaped tube of said substantially closed and laterally-oriented intermediate disk of said hollow and cylindrically-shaped body of said cap portion is in fluid communication with said second generally semi-cylindrically-shaped compartment of said hollow and cylindrically-shaped neck of said container portion.

8. The container as defined in claim 7, wherein said selection means includes a first pivotable and semi-circular-shaped cover that is pivotally mounted to said hollow and cylindrically-shaped body of said cap portion by a first pivot pin and selectively opens and closes that portion of said open and circular-shaped top of said hollow and cylindrically-shaped body of said cap portion that defines said top of said first semi-cylindrically-shaped compartment of said hollow and cylindrically-shaped body of said cap portion; said selected speed of the one fluid component of said first generally semi-cylindrically-shaped compartment of said hollow and generally cylindrically-shaped body of said container portion being dispensed therefrom is achieved by varying an amount that said first pivotable and semi-circular-shaped cover of said cap portion is opened; said first pivot pin of said first pivotable and semi-circular-shaped cover of said cap portion pivotally enters said cylindrically-shaped longitudinal side of said hollow and cylindrically-shaped body of said cap portion and pivotally enters perpendicularly said longitudinally-disposed and rectangular-shaped partition of said hollow and cylindrically-shaped body of said cap portion in a direction of an imaginary line drawn through said center point of said uppermost end of said second hollow and cylindrically-shaped tube of said substantially closed and laterally-oriented intermediate disk of said hollow and cylindrically-shaped body of said cap portion; said first pivot pin of said first pivotable and semi-circular-shaped cover of said cap portion divides said first pivotable and semi-circular-shaped cover into a first large sealing portion that has a lower surface that extends over and selectively opens and closes said uppermost end of said first hollow and cylindrically-shaped tube of said substantially closed and laterally-oriented intermediate disk of said hollow and cylindrically-shaped body of said cap portion while providing a reflective surface for achieving said selected direction of the one fluid component of said first generally semi-cylindrically-shaped compartment of said hollow and generally cylindrically-shaped body of said container portion being dispensed therefrom, and a first small pressing portion that is smaller than said first large sealing portion of said first pivotable and semi-circular-shaped cover of said cap portion, as a result of positioning of said first pivot pin of said first pivotable and semi-circular-shaped cover of said cap portion.

9. The container as defined in claim 8, wherein said lower surface of said first large sealing portion of said first pivotable and semi-circular-shaped cover of said cap portion has a first sealing ring disposed thereon to assure a positive seal with said uppermost end of said first hollow and cylindrically-shaped tube of said substantially closed and laterally-oriented intermediate disk of said hollow and cylindrically-shaped body of said cap portion.

10. The container as defined in claim 8, wherein said selection means further includes a first 90 degree sector-shaped throughbore that provides a clearance for receiving a finger of a user when the finger of the user presses downwardly on said first small pressing portion of said first pivotable and semi-circular-shaped cover of said cap portion to open said first hollow and cylindrically-shaped tube of said substantially closed and laterally-oriented intermediate disk of said hollow and cylindrically-shaped body of said cap portion; said first 90 degree sector-shaped throughbore of said selection means is disposed in said cylindrically-shaped longitudinal side of said hollow and cylindrically-shaped body of said cap portion and opens into said first semi-cylindrically-shaped compartment of said hollow and cylindrically-shaped body of said cap portion and whose one straight side is coincident with one end of said longitudinally-disposed and rectangular-shaped partition of said hollow and cylindrically-shaped body of said cap portion, whose other straight side opens into and is coincident with said open and circular-shaped top of said hollow and cylindrically-shaped body of said cap portion, and whose arcuate-shaped side extends therebetween.

11. The container as defined in claim 10, wherein said arcuate-shaped side of said first 90 degree sector-shaped throughbore of said selection means is upwardly and inwardly tapering, so that injury to the finger of the user when said first small pressing portion of said first pivotable and semi-circular-shaped cover of said cap portion is pivoted all the way downward is prevented.

12. The container as defined in claim 11, wherein said selection means further includes a second pivotable and semi-circular-shaped cover that is pivotally mounted to said hollow and cylindrically-shaped body of said cap portion by a second pivot pin and selectively opens and closes that portion of said open and circular-shaped top of said hollow and cylindrically-shaped body of said cap portion that defines said top of said second semi-cylindrically-shaped compartment of said hollow and cylindrically-shaped body of said cap portion; said selected speed of the another fluid component of said second generally semi-cylindrically-shaped compartment of said hollow and generally cylindrically-shaped body of said container portion being dispensed therefrom is achieved by varying an amount that said second pivotable and semi-circular-shaped cover of said cap portion is opened; said second pivot pin of said second pivotable and semi-circular-shaped cover of said cap portion pivotally enters said cylindrically-shaped longitudinal side of said hollow and cylindrically-shaped body of said cap portion and pivotally enters perpendicularly said longitudinally-disposed and rectangular-shaped partition of said hollow and cylindrically-shaped body of said cap portion in a direction of an imaginary line drawn through said center point of said uppermost end of said first hollow and cylindrically-shaped tube of said substantially closed and laterally-oriented intermediate disk of said hollow and cylindrically-shaped body of said cap portion; said second pivot pin of said second pivotable and semi-circular-shaped cover of said cap portion divides said second pivotable and semi-circular-shaped cover into a second large sealing portion that has a lower surface that extends over and selectively opens and closes said uppermost end of said second hollow and cylindrically-shaped tube of said substantially closed and laterally-oriented intermediate disk of said hollow and cylindrically-shaped body of said cap portion while providing a reflective surface for achieving said selected direction of the another fluid component of said second generally semi-cylindrically-shaped compartment of said hollow and generally cylindrically-shaped body of said container portion being dispensed therefrom, and a second small pressing portion that is smaller than said second large sealing portion of said second pivotable and semi-circular-shaped cover of said cap portion, as a result of positioning of said second pivot pin of said second pivotable and semi-circular-shaped cover of said cap portion.

13. The container as defined in claim 12, wherein said lower surface of said second large sealing portion of said second pivotable and semi-circular-shaped cover of said cap portion has a second sealing ring disposed thereon to assure a positive seal with said uppermost end of said second hollow and cylindrically-shaped tube of said substantially closed and laterally-oriented intermediate disk of said hollow and cylindrically-shaped body of said cap portion.

14. The container as defined in claim 12, wherein said selection means further includes a second 90 degree sector-shaped throughbore that provides a clearance for receiving the finger of the user when the finger of the user presses downwardly on said second small pressing portion of said second pivotable and semi-circular-shaped cover of said cap portion to open said second hollow and cylindrically-shaped tube of said substantially closed and laterally-oriented intermediate disk of said hollow and cylindrically-shaped body of said cap portion; said second 90 degree sector-shaped throughbore of said selection means is disposed in said cylindrically-shaped longitudinal side of said hollow and cylindrically-shaped body of said cap portion and opens into said second semi-cylindrically-shaped compartment of said hollow and cylindrically-shaped body of said cap portion and whose one straight side is coincident with an opposite end of said longitudinally-disposed and rectangular-shaped partition of said hollow and cylindrically-shaped body of said cap portion, whose other straight side opens into and is coincident with said open and circular-shaped top of said hollow and cylindrically-shaped body of said cap portion, and whose arcuate-shaped side extends therebetween.

15. The container as defined in claim 14, wherein said arcuate-shaped side of said second 90 degree sector-shaped throughbore of said selection means is upwardly and inwardly tapering, so that injury to the finger of the user when said second small pressing portion of said second pivotable and semi-circular-shaped cover of said cap portion is pivoted all the way downward is prevented.

* * * * *